US006363999B1

(12) United States Patent
Smith

(10) Patent No.: US 6,363,999 B1
(45) Date of Patent: Apr. 2, 2002

(54) VARIABLE TIP WIDTH ADJUSTMENT SYSTEM

(75) Inventor: Dennis M. Smith, Crestline, CA (US)

(73) Assignee: Fata Hunter, Inc., Riverside, CA (US)

( * ) Notice: Subject to any disclaimer, the term of this patent is extended or adjusted under 35 U.S.C. 154(b) by 0 days.

(21) Appl. No.: 09/533,525

(22) Filed: Mar. 23, 2000

Related U.S. Application Data

(60) Provisional application No. 60/169,003, filed on Dec. 3, 1999.

(51) Int. Cl.[7] ..... B22D 11/103; B22D 41/50

(52) U.S. Cl. ..... 164/480; 164/428; 164/440; 164/490; 222/606

(58) Field of Search ..... 164/453, 480, 164/488, 490, 155.4, 154.2, 428, 437, 439, 440; 222/594, 596, 606

(56) References Cited

U.S. PATENT DOCUMENTS

| | | | | |
|---|---|---|---|---|
| 2,128,941 | A | 9/1938 | Hudson | |
| 2,128,942 | A | 9/1938 | Hudson | |
| 2,790,216 | A | 4/1957 | Hunter | |
| 4,054,173 | A | 10/1977 | Hickam | 164/428 |
| 4,270,593 | A | 6/1981 | Bachner | 164/82 |
| 4,303,181 | A | 12/1981 | Lewis et al. | 222/591 |
| 4,641,767 | A | 2/1987 | Smith | 222/591 |
| 4,716,956 | A | 1/1988 | Hoffman et al. | 164/480 |
| 4,928,748 | A | 5/1990 | Guthrie et al. | 164/479 |
| 5,035,278 | A | 7/1991 | Hasegawa et al. | 164/428 |
| 5,178,205 | A | 1/1993 | Fukase et al. | 164/480 |
| 5,221,511 | A | 6/1993 | Fukase et al. | 266/45 |
| 5,238,049 | A | 8/1993 | Martin | 164/479 |
| 5,547,013 | A | 8/1996 | Sherwood | 164/416 |
| 5,755,274 | A | 5/1998 | Maiwald et al. | 164/479 |
| 6,095,383 | A | 8/2000 | Smith | 222/594 |

FOREIGN PATENT DOCUMENTS

| | | |
|---|---|---|
| DE | 2653126 | 6/1977 |

*Primary Examiner*—Kuang Y. Lin
(74) *Attorney, Agent, or Firm*—Christie, Parker & Hale, LLP

(57) ABSTRACT

A variable tip width adjustment system for use in continuous casting of a molten metal includes a feed tip nozzle downstream from a distribution box, the nozzle including a pair of feed tip nozzle members spaced apart to define a feed tip opening at a downstream edge of the feed tip nozzle members and a pair of end dams located on a drive side and an operator side of the roll casters, the end dams slidably engaged inside the tip nozzle, each dam being axially moveable in two directions inside the tip nozzle. The end dams are preferably actuated using a programmable controller and a stepper motor that is responsive to the signals of the programmable controller. The stepper motor is preferably connected to the end dam via flex connector and a connecting guide rod directed through a guide tube.

22 Claims, 4 Drawing Sheets

VARIABLE TIP WIDTH ADJUSTMENT SYSTEM

CROSS-REFERENCE TO RELATED APPLICATION

This application claims the benefit of Provisional Application No. 60/169,003, filed Dec. 3, 1999, the disclosure of which is incorporated fully herein by reference.

BACKGROUND OF THE INVENTION

This invention relates generally to a variable tip width adjustment system for a continuous casting machine and more particularly to a variable tip width adjustment system having movable end dams located inside the tip nozzle of a roll caster.

The formation and casting of metals and metal alloys of various kinds have been conducted for many years using commercial scale operations. For example, continuous twin roll casters, such as those shown in U.S. Pat. Nos. 2,790,216 and 4,054,173 are commonly used. The casters disclosed therein include an opposing pair of water cooled, counter-rotated and generally horizontally oriented casting rolls. Molten metal is routed through a feed system into the nip of the two rolls just prior to the closest approach of the rolls. Typically, the feed system includes an upstream head box and a feed tip nozzle. The metal is directed from the head box, through the feed tip nozzle and into the nip of the rolls. As the metal comes into contact with the water cooled casting rolls, heat is rapidly extracted and the metal begins to solidify. The solid metal is then compressed into a sheet as it passes through the gap between the caster rolls.

Conventional casters of this type generally have a fixed, non-movable end dam on each side of the tip nozzle. The purpose of the end dams is to prevent the molten metal from flowing outside of the tip nozzle overall width. Typically, to change the casting widths of a continuous strip caster, the caster must be stopped and a new tip nozzle with an alternate tip width installed. This process results in an extended down time of the caster and can be quite costly to customers who routinely cast multiple widths.

Those who are familiar in the art of continuous strip casting and are well versed on the conventional roll type casters have, in the past, illustrated the capability of changing the tip width while casting without requiring a complete halt of the caster. However, the methods previously used were unpredictable and were not common throughout the industry. Known width adjustment systems include the use of a series of plugs, i.e., removable end dams, inserted in the front section of the tip nozzle nearest to the nip of the caster rolls. A series of plugs is located on either side of the tip nozzle. Each plug is approximately 50 mm wide and includes an angle on the side of the plug that faces the metal that simulates an end dam. To widen the width of the strip, the plugs are removed. With the removal of each plug, the strip width is increased axially in an increment equal to the width of each plug removed. For example, if the casting width was originally 1550 mm wide and two plugs are removed, one from each side, the caster width increases to 1650 mm wide. This process can be repeated until the desired tip width is attained.

A disadvantage of the known width adjustment system is that the desired width cannot be attained with repeatable accuracy. Accordingly, it is desirable to provide a variable tip width adjustment system that can provide incremental precision of ±1 mm and can attain repeatable accuracy.

Additionally, it is desirable to provide a variable tip width adjustment system that can mechanically move a sliding end dam axially inside the tip nozzle in both directions, thereby allowing the width of the tip nozzle to be narrowed, as well as widened.

Finally, it is desirable to provide a tip width adjustment system that can be applied to new casters or retrofitted to existing roll casting lines.

SUMMARY OF THE INVENTION

A variable tip width adjustment system for use in continuous casting of a molten metal includes a feed tip nozzle downstream from a distribution box, the nozzle including a pair of feed tip nozzle members spaced apart to define a feed tip opening at a downstream edge of the feed tip nozzle members and a pair of end dams located on a drive side and an operator side of the roll casters, the end dams slidably engaged inside the tip nozzle, each dam being axially moveable in two directions inside the tip nozzle. The end dams are preferably actuated using a programmable controller and a stepper motor that is responsive to the signals of the programmable controller. In the alternative, the stepper motors could be actuated using a manual controller. The stepper motor, with a gear box, is preferably connected to the end dam via flex connector and a connecting guide rod directed through a guide tube.

The end dams preferably are composed of a material that is non-wetting to molten metal. In the preferred embodiment, the end dam has a thin layer of ceramic fiber paper glued to both the top and bottom surface of the end dam. The tip nozzle is preferably coated with a liquid boron nitride material or other coating having a high lubricity value allowing the moveable end dam to glide inside the tip nozzle without any grabbing or binding.

DESCRIPTION OF THE DRAWINGS

Other objects and advantages of the invention will become apparent upon reading the following detailed description and upon reference to the drawings in which.

DETAILED DESCRIPTION OF THE INVENTION

Figure 2:
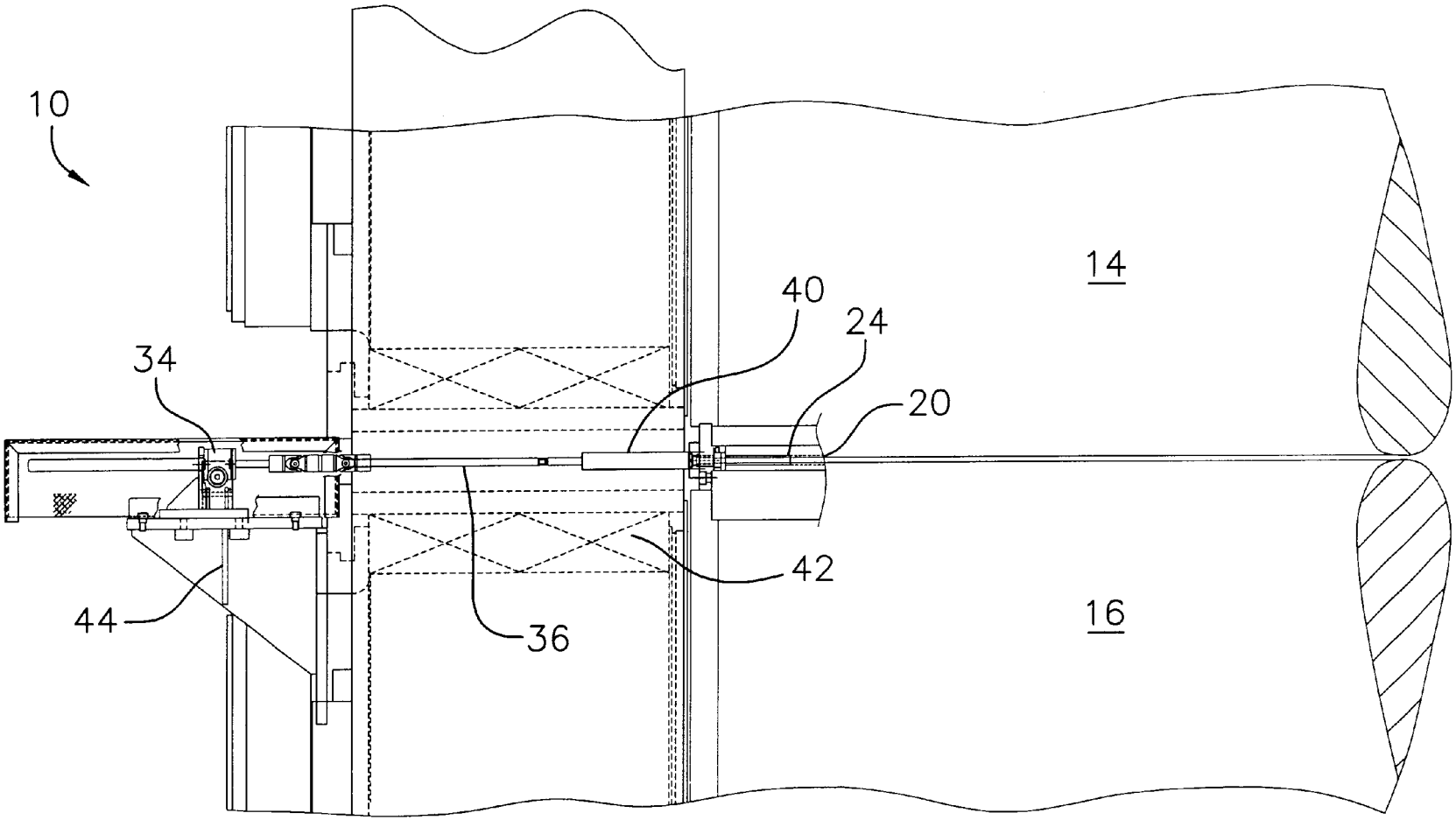
FIG. 2 is a front view showing the variable tip width adjustment system located in between the upper and lower bearing blocks, the tip nozzle and the tip base positioned in between the upper and lower caster rolls.
Figure 3:
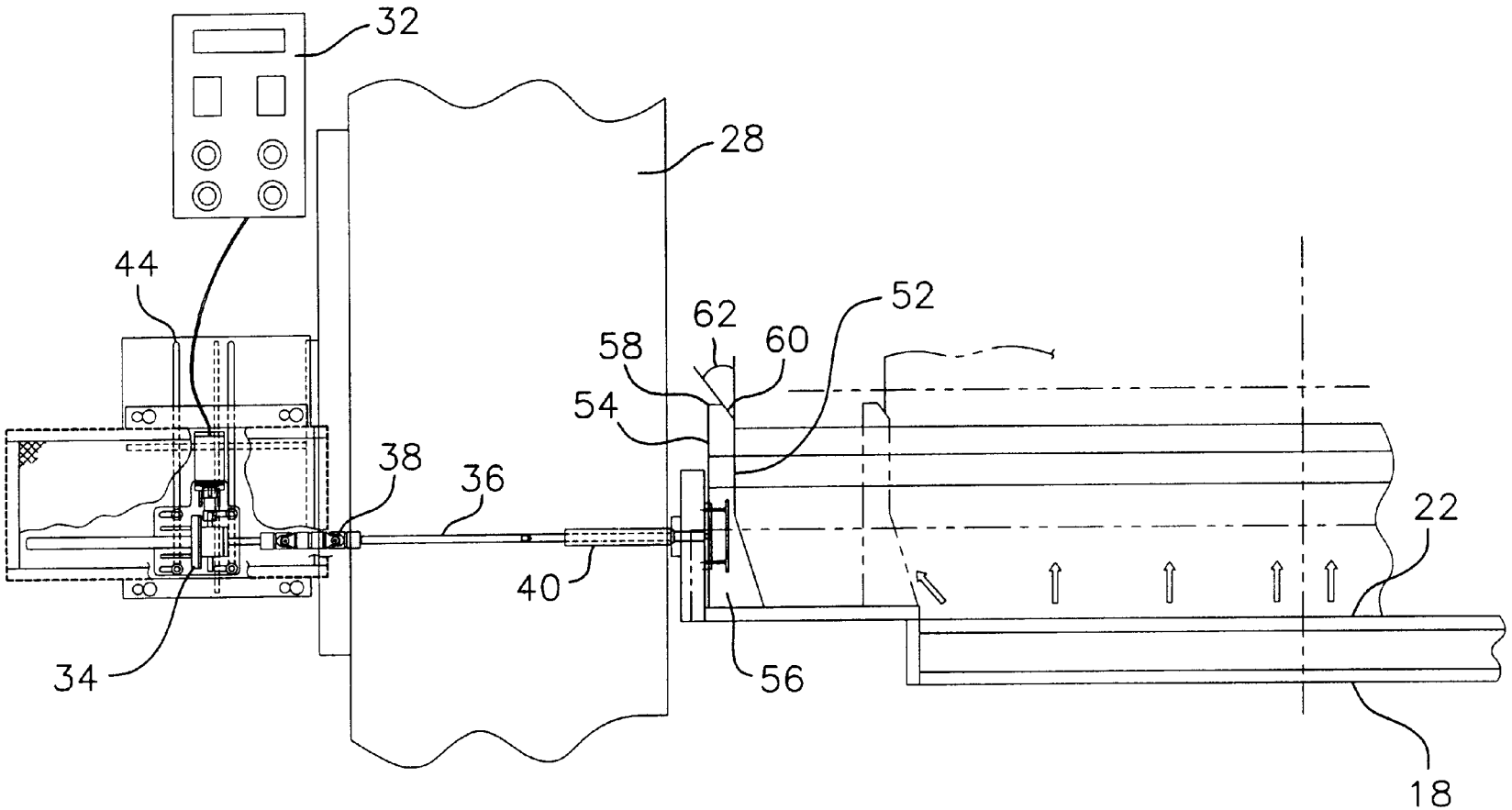
FIG. 3 is a plan view of the entire variable tip width adjustment system including the stepper driver control unit, stepper drive support base, stepper motor, guide rod, guide tube, caster frame, tip nozzle, moveable end dam and distribution box.

The variable tip width adjustment system 10 of the present invention is utilized in a molten metal feed system as shown in FIGS. 2 and 3. The molten metal feed system delivers fluid metal from a feed system into the space 12 or bite between the rolls 14, 16. The rolls 14, 16 are cooled, usually by a cooling liquid passing through circumferential channels, to provide a heat sink for the molten metal as is commonly known in the industry. The feed system generally comprises an open distribution box 18 adjacent to and downstream from a head box (not shown), and a feed tip nozzle 20 adjacent to and downstream from the distribution box 18. Molten metal is typically fed into the head box from a holding furnace and transfer system in which the metal alloy to be cast is maintained at the desired temperature. During casting, the metal flows from the head box to the distribution box. Thereafter, the metal flows through an outlet 22 of the distribution box 18 into a feed path between a pair of feed tip nozzle members 24.

The variable tip width adjustment system 10 is provided with moveable end dams 26 located inside the tip nozzle 20 on both the operator 28 and drive side 30 of the roll caster. The end dams 26 are moved automatically in and out axially by means of a programmable controller 32 which drives two stepper motors 34 with connecting guide rods 36 and flex couplings 38. The connecting guide rod 36 is preferably attached to an output shaft of the stepper motor 34 using a double-acting flexible coupling. The guide connecting rod 36 is directed through a guide tube 40 before being connected to the moveable end dam 26.

Each end dam 26 has an inner surface 52 and an outer surface 54. The inner surfaces 52 of the end dams define the feed path. In the preferred embodiment, the end dams have a lower portion 56 and an upper portion 58. The width of the lower portion 56 preferably tapers as it approaches the upper portion 58. The tapered shape assists in guiding the feed path of the molten metal. The upper portion preferably has a uniform width. The upper portion preferably has a cut-out corner 60. The cut-out angle 62 preferably is in the range of 30 to 45 degrees. The angled corner provides relief for the metal flow. If the corner were not angled, the metal could tear as it separated from the end dam corner.

The top and bottom surfaces 48, 50 of the end dams are preferably shaped to correspond to the shape of the tip nozzle 20.

Figure 1:
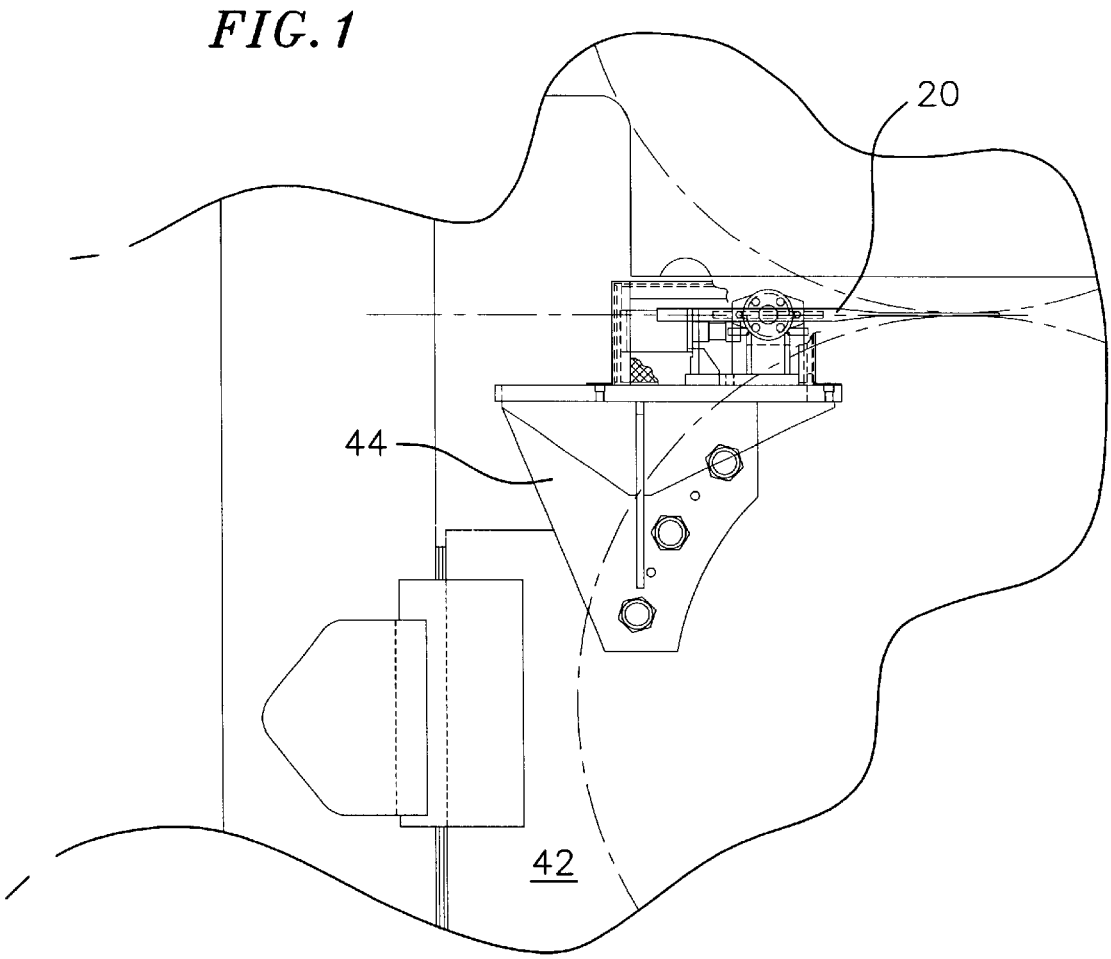
FIG. 1 is an elevation end view of the variable tip width adjustment system showing the support base attachment to the bearing block and the positioning of the tip in between the caster rolls.

The system 10 is mounted directly to the caster bearing blocks 42 as best shown in FIGS. 1, and 2. Stepper motor 34 is preferably attached to a support base 44 which is in turn attached to the caster bearing blocks 42. The attachment of the motor 34 to the support base 44, and the attachment of the support base 44 to the caster bearing blocks 42 can be accomplished using known fasteners.

The end dams 26 can be moved simultaneously or independently of each other. Furthermore, the end dams could be moved at different rates. If the dams 26 are moved manually, a potentiometer should be used. If moved by a programmable computer, there is no need for a potentiometer. In the preferred embodiment, both end dam assemblies 26 are moved together in or out at the same time, as the width of the strip must be balanced on each of the roll face centerline. This precise movement assures strip profile symmetry.

Each moveable end dam 26 is preferably fabricated by compressing dense ceramic fibers into a two piece steel mold with a metal anchor embedded in the fiber during the molding process. However, the moveable end dam can be any material which is non wetting to molten metal and has equivalent chemical and physical characteristics.

Figure 4:
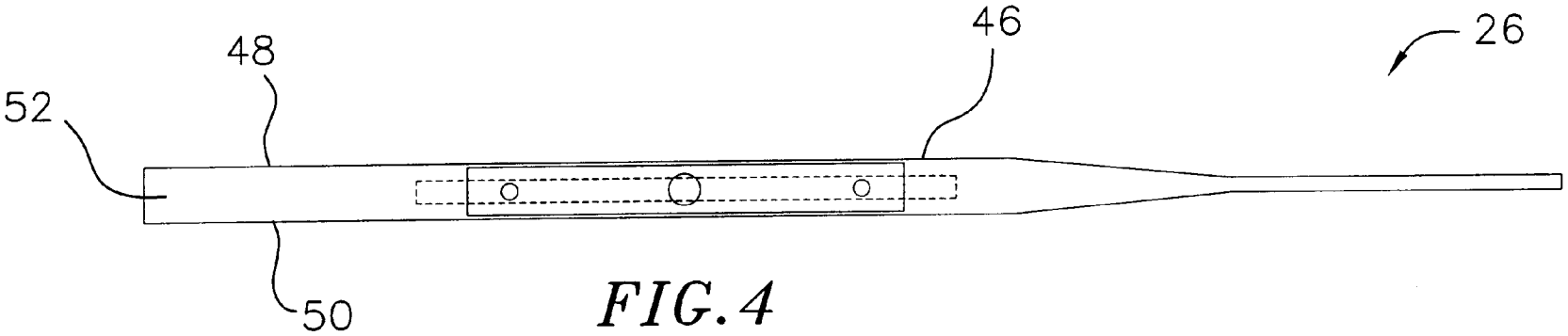
FIG. 4 is an end view of one of the moveable end dams of the variable tip width adjustment system.

In the preferred embodiment, as shown in FIG. 4, the moveable end dam 26 has a thin layer of ceramic fiber paper 46 approximately glued to both the top surface 48 and bottom surface of 50 the end dam 26. The thickness of the ceramic fiber paper is preferably in the range of 0.76 mm to 6.35 mm. This fiber acts as a frictionless seal to protect against leakage and wear. The tip nozzle 20 is coated with a liquid boron nitride material which is common in the art of casting with roll casters. This coating is similar to a graphite type coating which has a high lubricity value allowing the moveable end dam covered with the fiber paper to glide inside the tip nozzle without any grabbing or binding.

The support base 44 is mounted on both the operator 28 and drive sides 30 of the caster lower bearing blocks 42. The stepper motors 34 and guide rods 36 are mounted on the support base 44 and are located in direct line with the caster tip nozzle 20.

The variable tip width adjustment system is preferably to be used with the baffle-less tip nozzle which is free of any baffles or obstructions in the nozzle cavity. A baffle-less tip is described in U.S. patent Ser. No. 09/183,185 filed Oct. 30, 1998, entitled "Adjustable Molten Metal Feed System," the contents of which are incorporated herein by reference. The variable tip width adjustment system can be used with baffles inside the tip nozzle if the baffles are placed in the middle area, away from the sliding end dams. The sliding end dams must be permitted to move freely without any obstructions. The linear adjustable range of movement of the moveable end dams is preferably in the range of 300 mm per side.

The 300 mm maximum per side is governed by the strip profile which is dependent on the following casting parameters: the alloy being cast, strip gauge, tip setback, roll speed and roll crown requirement. The strip width affects the strip profile as the roll crown is fixed so if the 300 mm per side, or 600 mm cumulative total width change, is exceeded the roll crown must be adjusted to compensate for the additional roll bending.

While the invention is disclosed with specific embodiments thereof, it is to be evident that many alternatives, modifications, and variations will be apparent to those skilled in the art in light of the foregoing description. Accordingly, it is intended to embrace all such alternatives, modifications and variations as falling within the spirit and broad scope of the appended claims.

What is claimed is:

1. In a metallurgical apparatus which comprising a variable tip width adjustment system for use in continuous casting of a molten metal; the adjustment system comprising:

a feed tip nozzle downstream from a distribution box, the nozzle including a pair of feed tip nozzle members spaced apart to define a feed tip opening at a downstream edge of the feed tip nozzle members; and a pair of end dams slidably engaged inside the tip nozzle, each end dam being axially moveable in two directions inside the tip nozzle.

2. The variable tip width adjustment system according to claim 1, comprising an operator side, and a drive side distal from the operator side, one of the end dams located on the operator side and the other end dam located on the drive side.

3. The variable tip width adjustment system according to claim 1, comprising a programmable controller for actuating the end dams.

4. The variable tip width adjustment system according to claim 3, comprising a first stepper motor responsive to the programmable controller.

5. The variable tip width adjustment system according to claim 4, comprising a first guide rod for mechanically connecting the first stepper motor to one of the end dams, wherein the one of the end dams is moved axially by the first stepper motor in response to the programmable controller.

6. The variable tip width adjustment system according to claim 5, comprising a second stepper motor and a second guide rod for mechanically connecting the second stepper motor to the other end dam, wherein the other end dam is moved axially by the second stepper motor in response to the programmable controller.

7. The variable tip width adjustment system according to claim 5, comprising a guide tube wherein the first guide rod is directed through the guide tube.

8. The variable tip width adjustment system according to claim 5, comprising a flexible coupling for attaching the first guide rod is attached to the first stepper motor.

9. The variable tip width adjustment system according to claim 1 wherein the end dams comprise a material that is non-wetting to molten metal.

10. The variable tip width adjustment system according to claim 1, wherein each end dam comprises a top surface and a bottom surface and a ceramic fiber paper disposed on each of the top surface and bottom surface of the end dam.

11. The variable tip width adjustment system according to claim 9 wherein the ceramic fiber paper has a thickness in the range of approximately 0.76 mm to 6.35 mm.

12. The variable tip width adjustment system according to claim 1 wherein the tip nozzle is coated with a liquid boron nitride material.

13. A variable tip width adjustment system according to claim 6 wherein the end dams are moved simultaneously at the same rate.

14. A variable tip width adjustment system according to claim 13 wherein a linear adjustable range of movement of the moveable end dams is approximately 300 mm per side.

15. A variable tip width adjustment system according to claim 5, comprising a support base and a lower caster bearing block, wherein the stepper motor is mounted on the support base and wherein the support base is mounted on the lower caster bearing block.

16. A variable tip width adjustment system according to claim 1, wherein each end dam has an top surface and a bottom surface, and wherein the tip and bottom surfaces of the end dams are shaped to correspond to the shape of the feed tip nozzle.

17. A variable tip width adjustment system according to claim 1, comprising a manual controller for actuating the end dams.

18. A method of continuous casting of a casting of a molten metal, comprising the steps of:

providing a variable tip width adjustment system having a feed tip nozzle, the nozzle including a pair of feed tip nozzle members spaced apart to define a feed tip opening at a downstream edge of the feed tip nozzle members, a pair of end dams slidably engaged inside the tip nozzle, a programmable controller, and a stepper motor responsive to the controller and mechanically connected to one of the end dams;

programming the controller to send a signal to the stepper motor to move one of the end dams; and moving the end dam in response to the signal sent by the programmable controller.

19. A method according to claim 18 wherein the variable tip width adjustment system comprises a second stepper motor responsive to the programmable controller and connected to the other end dam, the method further comprising the step of moving the other end dam in response to the signal send by the programmable controller.

20. A method according to claim 19 wherein the end dams are moved simultaneously at the same rate.

21. A method according to claim 18 wherein a linear adjustable range of movement of the moveable end dams is approximately 300 mm per side.

22. A method according to claim 18 wherein the each end dam comprises a top surface, a bottom surface, and a ceramic fiber paper disposed on each of the top and bottom surfaces of the end dam.

* * * * *

UNITED STATES PATENT AND TRADEMARK OFFICE

CERTIFICATE OF CORRECTION

PATENT NO. : 6,363,999 B1
DATED : April 2, 2002
INVENTOR(S) : Dennis M. Smith

It is certified that error appears in the above-identified patent and that said Letters Patent is hereby corrected as shown below:

Column 4,
Line 38, replace “comprising” with -- comprises --.

Column 5,
Line 9, after “rod” delete “is attached”.
Line 35, replace “an top” with -- a top --.

Column 6,
Line 25, replace “send” with -- sent --.
Line 31, after “wherein” and before “each” delete “the”.

Signed and Sealed this

Fourth Day of March, 2003

JAMES E. ROGAN
*Director of the United States Patent and Trademark Office*